United States Patent [19]

Boucher

[11] 4,088,986

[45] May 9, 1978

[54] SMOKE, FIRE AND GAS ALARM WITH REMOTE SENSING, BACK-UP EMERGENCY POWER, AND SYSTEM SELF MONITORING

[76] Inventor: Charles E. Boucher, 423 Lucier St., Murphysboro, Ill. 62966

[21] Appl. No.: 728,813

[22] Filed: Oct. 1, 1976

[51] Int. Cl.[2] ..... G08B 21/00

[52] U.S. Cl. ..... 340/237 S; 324/71 SN; 340/237 R; 340/249; 340/333

[58] Field of Search ..... 340/237 S, 237 R, 249; 324/71 SN

[56] References Cited

U.S. PATENT DOCUMENTS

| | | | |
|---|---|---|---|
| 3,750,123 | 7/1973 | Caillouet, Jr. | 340/237 R |
| 3,786,462 | 1/1974 | Hayden | 340/237 R |
| 3,801,972 | 4/1974 | Ho Kim et al. | 340/237 R |
| 3,815,114 | 6/1974 | Johnson | 340/237 R |
| 3,860,919 | 1/1975 | Aker | 340/237 R |
| 3,877,291 | 4/1975 | Hoppesch et al. | 340/237 R X |
| 3,879,717 | 4/1975 | Gruensfelder | 340/237 R |
| 3,882,478 | 5/1975 | Skarman | 340/237 R |
| 3,895,367 | 7/1975 | Visser | 340/237 R |
| 3,906,473 | 9/1975 | LeVine | 340/237 R |
| 3,950,155 | 4/1976 | Komiyama | 340/237 R X |
| 3,950,739 | 4/1976 | Campman | 340/237 R |
| 3,955,186 | 5/1976 | Green et al. | 340/237 R |
| 4,007,456 | 2/1977 | Paige et al. | 340/237 R |
| 4,012,692 | 3/1977 | Eicker | 324/71 SN |
| 4,020,480 | 4/1977 | Gotley et al. | 340/237 R |

OTHER PUBLICATIONS

Motorola Application Note AN-735, "Solid State Gas/Smoke Detector Systems."

Figaro report of Apr. 1975, "Figaro Gas Sensor", #711 and #812.

Radio Electronics article, "Build a Gas Sensor," Jul. 1976.

*Primary Examiner*—John W. Caldwell, Sr.

*Attorney, Agent, or Firm*—David H. Semmes; Warren E. Olsen

[57] ABSTRACT

A system for sensing smoke and fire, primarily through the sensing of associated carbon monoixide and optionally with supplementary heat sensing, and for sensing hazardous gases and vapors. The system senses the presence of carbon monoxide, even in the absence of fire and is capable of sensing the presence of hydrogen and hydrocarbon vapors such as methane and propane. Additionally, the volatile vapors of paints, varnishes and other household and industrial substances are detectable. The system also includes circuitry and equipment for notification and warning of such detection, together with circuitry and equipment for providing emergency operation in the event of normal power failure. Further circuitry and equipment for self-monitoring of system remote wiring and sensor integrity, and associated notification means for such integrity checks is included. The system provides for the use of a suitable multitude of sensor devices located remotely from a main control unit, so that sensor device locations may be chosen to maximize the possibility of detecting the presence of smoke, fire or the gases and vapors previously described. The system also includes a novel form of sounding device, of the type wherein an electro-magnet causes a hammer to strike a sounding apparatus with such sounding devices being suitable for use in flammable, combustible or otherwise reactive atmospheres.

16 Claims, 8 Drawing Figures proper operating conditions. Secondly, it performs the function of determining and notifying the Alarm Drive that an alarm condition exists. Thirdly, it monitors the integrity of the remote sensor unit and remote sensor unit wiring and notifies the Alarm Drive of any lack of integrity. Outputs of the Logic element include a signal indicating a failure of sensor unit, or sensor unit wiring integrity. The Logic element comprises integrated circuit logic devices, false alarm reduction circuitry and equipments, and circuitry and equipments for adjustment of system sensitivity.

A fifth element may be considered the Alarm Drive, comprising an Oscillator for generation of signals which are processed and a power drive output to the Alarm or Sounding Device. The signals generated by the Oscillator preferably drive a novel form of a sounding device of the buzzer, horn or bell variety. Unlike current buzzers, horns or bells, the novel sounding device is suitable for use in a combustible, flammable or otherwise reactive atmosphere.

The sixth element of this invention may be considered the Alarm or Sounding Device. The input of this element is driving power from the Alarm Drive and the output is an audible frequency. The audible frequency provides notification that the Logic element has generated an output indicative of the occurrence of the presence of a condition to which the Sensor Unit is responsive. Whereas this invention detects combustible or detonatable gases, it is necessary that no element, device or equipment within the invention itself initiate burning or detonation in the gas within the area being protected. The invention describes two classes of alarms suitable for employment within the system. The first class is a type of interrupter contact device that employs a novel form of springed hammer and electromagnetic device so that no sparks are created as the result of hammer actuation. The second class is an interrupter-contact type, such as the bell, horn or buzzer, that is modified to eliminate the possibility that such a device will cause reaction of the combustible or burnable gas or vapor outside the volume of the sounding device.

In totality this invention possesses, but is not limited to possessing, the following characteristics:

1. Suitability for the detection, and notification of heat, smoke, carbon monoxide, hydrogen, gaseous or vaporous hydrocarbons, volatiles of paints, varnishes, household and industrial substances.

2. Use of a single control and notification unit accepting inputs from a multitude of remote sensor units.

3. Ability to accept multiple semiconductor sensor inputs that differ in both heater power requirements and response characteristics.

4. Use of a heat sensor to supplement the semiconductor sensor in applications where stoichiometric combustion can be expected.

5. Ability to locate sensors in locations most advantageous to serve the intended purpose.

6. Increased detection sensitivity for the intended gases and vapors, with power and voltage regulation to minimize false alarm rates at high sensitivity.

7. Increased performance and repeatibility with reduced false alarm rate through a regulated heater power for semiconductor sensors.

8. Reduction of false alarm rate through the use of a regulated logic power supply.

9. Wide applicability for use in home, industrial and commercial dwellings, air, surface, subsurface and space vehicle systems due to the type of power supply and sensor chosen.

10. Suitability for use with a variety of classes of sounding devices due to the use of an adaptable Alarm Drive Circuitry and equipment.

11. Ability to continue emergency operation in the case of loss of normal power due to the inclusion of an emergency back-up power supply.

12. Increased reliability through the use of emergency back-up power condition monitoring circuitry and equipment.

13. Ability to self monitor for integrity of remote sensor unit connecting wiring and integrity of sensors and sensor units and to notify of the lack of such integrity.

14. Capability of using interrupter-contact type horn, buzzer, or bell Alarm or Sounding devices through electrical modification and the use of a novel alarm Drive circuitry.

15. Capability of using an interrupter-contact horn, buzzer or bell type alarm or sounding devices through mechanical modification to prevent flame from propogating outside the volume of the horn, buzzer or bell.

16. Inclusion of an alarm inhibit delay to prevent false alarms during the warm-up period of the sensor.

Other features and advantages of the present invention will become more apparent by consideration of the following detailed description of the preferred embodiments, wherein reference is made to the accompanying drawings.

DESCRIPTION OF THE PREFERRED EMBODIMENTS

Figure 1:
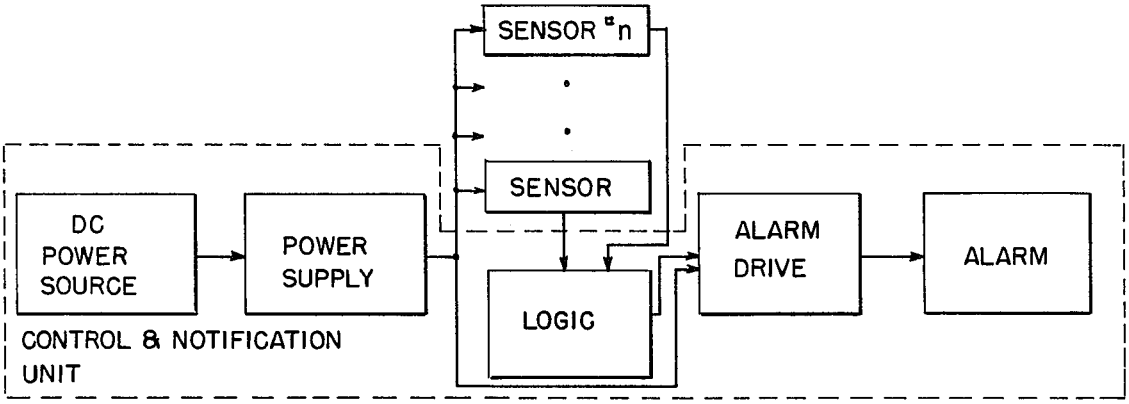
FIG. 1 is a block diagram representation of the preferred embodiment of this invention.
Figure 2:
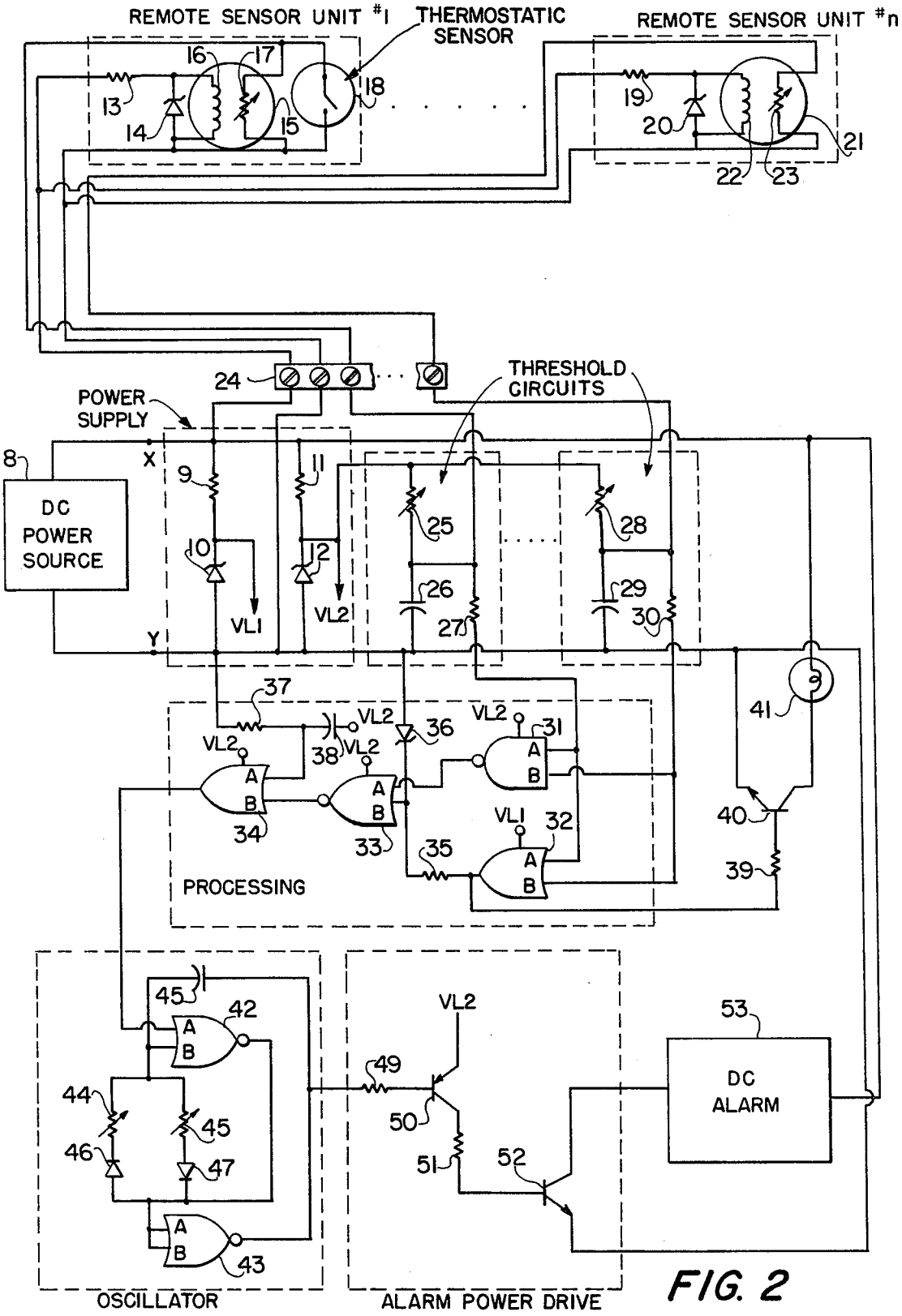
FIG. 2 is a schematic representation of the components of a preferred embodiment of the invention.

The basic combination of the present invention is shown in block form in FIG. 1, with component elements further detailed in FIG. 2. Power for the system is provided by a DC Power Source, 8, which is described in further detail later. The DC Power source feeds into the Power Supply, identified by a dashed outline, and the outputs of the power supply are several voltages. Voltage for the threshold circuits, as identified within another dashed outline, is taken across zener diode, 12, and is identified as VL 2. This same voltage is also used as the voltage source for logic elements 31, 33, 34, 42 and 43, as well as for transistor 50. Voltage VL 2 is a constant regulated voltage since it is taken across

SMOKE, FIRE AND GAS ALARM WITH REMOTE SENSING, BACK-UP EMERGENCY POWER, AND SYSTEM SELF MONITORING

BACKGROUND OF THE INVENTION

The problem of detecting the presence of smoke and fire and carbon monoxide, hydrogen and hydrocarbon gases and vapors is associated with the problem of protecting life and property. Hazardous, potentially hazardous, or abnormal condition related to fires or explosions include the presence of certain toxic, combustible or detonatable gases and vapors such as carbon monoxide, hydrogen and gases and vapors of hydrocarbons such as methane and propane. The volatiles of most paints and varnishes, including the volatiles of numerous household and industrial compounds containing hydrocarbons are also associated with fire explosion and health hazards. Certain devices and systems currently do provide some capability for protecting life and property against the hazards of fires and toxic and combustible and detonatible gases and vapors. Sensor devices used in prior art systems include ionization and photoelectric chambers, for smoke detection, the heated, doped, semiconductors that work on the principle of resistance changes for adsorbtion of certain gases for detection of such gases, and thermostatic switches for detecting heat. All currently available systems using such devices exhibit shortcomings that fall short of total protection against the hazardous presences previously described. Deficiencies of some or all of the current systems include cost of installation, cost of maintenance, fluctuations in performance with unacceptable false alarm rates accompanying increasing sensitivity performance and failure to detect a fire that gives off low quantities of carbon monoxide. Significantly, the notification devices in prior art systems may create further danger to life and property through combustion or detonation of certain gases or vapors upon actuation of the sounding device itself. Additionally, most systems fail to provide a second power source for back-up emergency operation. Finally, most prior art devices require that the alarm circuitry and equipment be duplicated within each sensor unit, unlike the present invention which requires only a multiple of sensor units to achieve total area protection.

The main object of this invention is to provide a total system to accurately detect and warn of the presence of smoke, fire, carbon monoxide, hydrogen and hydrocarbon gases, volatiles of paints, varnishes and other household and industrial compounds containing hydrocarbons. The object has a related object to warn with a performance level equal to or greater than existing systems, and to warn without the danger of causing fire or explosion as a consequence of the alarm design itself.

SUMMARY OF THE INVENTION

This invention is operable to detect and warn of the presence of smoke, fire, harmful, toxic, combustible, detonatable or potentially harmful gases such as carbon monoxide, hydrogen, gases and vapors of hydrocarbons such as methane and propane, and volatiles of paints, varnishes and other household and industrial substances. This invention activates a novel sounding device or alarm when such presences are detected, and continues sounding the alarm as long as such presences exist. Further features of the invention include a single control and alarm unit capable of accepting multiple sensor inputs, emergency back-up operation in the event of normal power failure, reliable operation with low false alarm rates, and safe alarm operation in combustible or detonatable environments.

This invention comprises six distinctly identifiable elements, although subsystem identification can be performed in a variety of ways and it is not intended that following representation preclude all other classifications.

The first element of this invention may be considered the DC Power Source. The power source consists of a Normal Power Source, and Emergency Back-Up Power Source. The power source includes circuitry and equipments for maintaining that source at a full power condition and for monitoring the suitability of that power source, with a power selector for automatically choosing between the two power sources, as appropriate. The normal power source could be, but is not intended to be limited to, a rectified and filtered output of a transformer coupled or direct coupled, household electrical line or a rectified and filtered output of a vehicular generator or alternator. The emergency back-up power source could be, but is not intended to be limited to, ordinary dry cells or rechargeable lead acid or nickle-cadmium batteries.

The second element of this invention may be considered the Power Supply, The DC Power Source Inputs to the Power Supply. The Power Supply develops the voltage and power levels required by the remaining elements of this invention. A significant feature of the Power Supply taught herein is the ability to provide regulated power inputs, thereby increasing both repeatability of system performance and sensitivity, while decreasing false alarm incidence.

A third element may be considered the remote sensors, or responding device. A multitude of sensors can be used with this invention, wherein FIG. 1 illustrates two remote sensors. The preferred sensor is of the type wherein resistance changes occur in the presence of the condition to be detected. Such sensors are available, per se, and may be of the type described in the U.S. Pat. Nos. 3,625,756, 3,631,436 or 3,900,815 by Taguchi as heated, doped semiconductors whose resistance decreases in the presence of certain gases and vapors. The sensor may alternatively be a thermostatic switch type, of a combination of both types. A significant characteristic of the first sensor is the requirement for heater power wherein response characteristics are altered by changes in heater power. The present invention provides a regulated heater power input to insure repeatability of operation, and a regulated voltage input to insure repeatability and high sensitivity.

According to the preferred embodiment, a first sensor is of the first type wherein the first Sensor outputs a current whose magnitude is related to the existing concentration of carbon monoxide, hydrogen and gaseous or vaporous hydrocarbons. A second sensor is employed with the first, and preferably is a thermostatic switch which closes upon the sensing of heat. The particular sensor or sensors chosen may be responsive to smoke or to one of the gases or vapors listed above, or they may be chosen for responsiveness to a multitude of hazardous conditions.

A fourth element of this invention may be considered the LOGIC element. This element provides three functions. Firstly, it inhibits alarm condition sensing for a suitable time delay after the application of power to allow time for the semiconductor sensors to establish zene diode, 12, which, operating in conjunction with dropping resistor, 11, functions as a constant voltage device. The voltage for logic element, 32, is identified as VL 1, and is taken across a zener diode, 10, which operates with resistor, 9, to provide a constant regulated voltage. Voltages VL 1 and VL 2 are regulated to prevent changes in operating thresholds of the system when the output of the DC Power Source changes, due to the normal and expectable fluctuations. Maintaining constant thresholds provides a constant and repeatable system sensitivity. Voltage VL 1 is larger than voltage VL 2, typically twice as large, for a reason to be explained hereinafter. The power supply also provides a DC Power Source voltage to the sensors of Remote Sensor Unit assemblies, shown at the top of FIG. 2, so that a regulated heater power is developed and fed to sensor heater elements, 16 and 22, for reasons to be described. The Power Supply also passes the output of the DC Power Source on to the Alarm Device where it may be directly used without need for further processing.

Shown in the embodiment of FIG. 2 are two exemplary semiconductor sensors, 21 and 15, with sensor 15 being supplemented by a thermostatic sensor, 18. Clearly, it is not the intent of this invention to so restrict the sensors to precisely these configurations. Any number from 1 to *n*, may be employed, and combinations of sensor types may be employed. Each sensor requires a separate Threshold Circuit, with these being exampled within dashed boxes for sensors 1 and *n*. Logic gates, 31 and 32 are similarly exemplary, and selected in accordance with the number of sensors used. To use with only one sensor both inputs of logic gates 31 and 32 are tied together. For use with two sensors, as shown in FIG. 2, the gates 31 and 32 are as shown. To use with n sensors gates 31 and 32 are *n* input, or their equivalent, type.

Typical Remote Sensor Unit assemblies are illustrated in FIG. 2 to comprise resistor 13, zener diode 14 and a sensor component, 15. In this preferred embodiment, sensor unit 15 may be of a type known and described in the commercial literature as the "Taguchi Gas-Sensor" (TGS) and may, for example, be similar to the sensor described in Taguchi, U.S. Pat. No. 3,900,815.

Such known sensors comprise a heater, 16, for elevating the temperature of a doped semiconductor, 17, in order to establish the proper operating conditions. The sensor employs a current which flows through the heated semiconductor, 17, with its resistance being inversely proportional to the concentration of detectable gases or vapors present. As shown in FIG. 2, heater power for such a typical sensor 15 is provided through zener diode, 14, and a resistor, 13. Zener diode 14 is wired across sensor heater 15, which is thereby maintained at a constant temperature. The zener value is chosen for correspondence with the voltage requirements of sensor heater 16. Sensor 15 may be that as manufactured by Figaro Engineering, Inc. of Osaka, Japan, and available as type 812. This particular sensor requires a heater voltage of 5 volts, consequently an associated zener diode would be 5 volts. The resistance of resistor 13 is then chosen so that the proper heater voltage is maintained over the expected variations in the output of the DC Power Source. The purpose of so locating a zener diode, 14, and resistor, 13, remotely with each sensor 15 is to prevent changes caused by changes in system performance wiring to the main control unit. Hence, changes in the resistance of interconnecting wires will not cause changes in the sensor heater power. Sensor 15 is illustrated in FIG. 2 to be supplemented by a Thermostatic Heat Sensor, 18, in anticipation of applications where a fire may not produce sufficient quantities of carbon monoxide to influence sensor 15. The thermostatic sensor 18 is in parallel with sensor 15.

As further shown in FIG. 2, any number of previously described remote sensor units may be connected to the five other identifiable elements, shown in FIG. 1, by a connecting junction block 24, in FIG. 2.

An exemplary Threshold Circuitry, for sensor No. 1, consists of a variable resistor, 25, a capacitor, 26, and a resistor, 27. Resistor 27 may typically be 10 MEGOHMS. Resistor 27 connects the output of the first threshold circuit to logic gates 31 and 32, and operates in conjunction with capacitor 26 as a filter to prevent spurious signals from entering the logic gates. One terminal of variable resistor 25 is connected to voltage VL 2, and the other terminal is connected to the sensing element, illustrated as a variable resistor 17, within sensor 15. Resistances 25 and 17 operate together, to act as a voltage divider. The output of the threshold circuit is the voltage appearing at the junction of resistors 25 and 17, because the input resistance of logic gates 31 and 32 are extremely high, thereby preventing voltage drop across resistor 27. Under normal quiescent conditions, the variable resistor 25 is adjusted so that the voltage appearing at the input of the NAND logic gate, 31, represents a logic "1." Voltage VL 1 is chosen, by choice of zener diode 10, so that this same voltage appears as a logic "0" to the OR logic gate, 32.

In further illustration, the logic gates herein are of the complementary, Metal-Oxide Semiconductor (CMOS) type, so that a logic "1" input to those devices is represented by a voltage level equal to about 40% of the device supply voltage. With reference to FIG. 2, VL2 may be 6 volts and VL 1 may be set at 9 volts. Then, a logic "1" for gate 31 is 2.4 volts, and for gate 32 is 3.6 volts. Resistor 25 can then be adjusted so the voltage at both input A of gate 31 and input A of gate 32 is 2.8 volts. It can be seen that input A to gate 31 is a logical "1" and input A of gate 32 is a logical "0."

Under quiescent, normal, non-alarm conditions, the status of the gates in the PROCESSING circuitry, within the dashed outline of FIG. 2, are:

| GATE | INPUT A | INPUT B | OUTPUT |
|---|---|---|---|
| NAND (31) | 1 | 1 | 0 |
| OR (32) | 0 | 0 | 0 |
| NOR (33) | 0 | 0 | 1 |
| OR (34) | 0 | 1 | 1 |

A logical "1" at the output of gate 34 disables the oscillator, thereby silencing the alarm.

The generation of an alarm signal will now be explained with reference to a typical remote sensor unit, with its associated threshold circuit, as shown in FIG. 2. When a gas of vapor to which sensor 15 is responsive comes into contact with that sensor, resistance 17 decreases. This causes the output voltage of the threshold circuit to decrease which in turn causes input A of gate 31 to go to a logical "0." The output of gate 31 becomes a logical "1" that renders input A of gate 33 a logical "1," rendering the output of gate 33 to a logical "0." With input B of gate 34 at a logical "0," the output of gate 34 goes to a logical "0," which in turn enables, or activates, the Oscillator, as shown in dashed outline in FIG. 2. Enabling the Oscillator enables the Alarm Power Drive which in turn causes the alarm to be sounded. The system is self resetting because resistance 17 will increase to its normal quiescent value after the removal of the gas or vapor which initially caused the alarm; as all gates return to their original states the alarm is turned off. If thermostatic 18 is activated, by heat, sensor 15 is short circuited, thereby achieving the same effect as a decrease in resistance of sensor 15.

A significant feature of this invention is the ability to self monitor. The sensors are remotely located from the main alarm unit, and connected thereto only by lengths of wire. These lengths of wire are susceptible to damage by fires, rodents, acts of nature, and similar hazards. It is clearly necessary to monitor the integrity of each Remote Sensor Unit assembly, and its connecting wires, and to effect a notification if the integrity is interrupted. The integrity of the sensor heater and connecting wires is monitored by components in the threshold circuitry. The monitoring function can be appreciated with reference to remote sensor unit 1 and the associated Threshold Circuit as illustrated in FIG. 2. As previously explained, under normal quiescent conditions inputs A & B of the OR gate, 32, are logical "0." A logical "0" at that point causes a logical "1" to appear at the output of gate 34, resulting in no alarm signal. Failures that could occur in the remote sensor wiring include an open circuit in the interconnecting wires, an open circuit in the sensor heater or an open circuit in the sensor resistance. In all cases, the voltage at the juncture of resistors 17 and 25 increase to a level corresponding to a logical "1" at gate 32. A logical "1" at gate 32 causes a logical "1" at input B of gate 33. This causes a logical "0" at input B of gate 34, which in turn causes a logical "0" at the output of gate 34 that will sound the alarm in the manner previously described.

Additional circuitry and circuit elements necessary to the implementation of the self-monitoring feature are resistor 35 and zener diode 36. The source voltage for gate 32 is VL1, consequently a level "1" output of that gate is approximately VL1. However, the source voltage to gate 33 is VL2, and VL2 is less than VL1. To prevent damage to gate 33 it is necessary to limit its input voltages to VL 2 or less. Zener diode 36 operates in conjunction with dropping resistor 35 to provide the limiting function. When the output of gate 32 goes to a logical "1," or VL1, zener diode 36 conducts. The output of gate 32 is divided between zener diode 36 and resistor 35, so that the voltage at input B of gate 33 is the voltage across zener diode 36. The zener value of zener diode 36 is chosen to be equal to VL2, which is the maximum input voltage which gate 33 can safely accept.

Another feature of this invention is the ability to disable the alarm during an initial sensor stabilization period, after an initial application of power. This function is performed by capacitor 38 and resistor 37. When power is first applied, capacitor 38 is uncharged and the logic voltage, VL2, is impressed on input A of gate 34, thereby causing the output of that gate to assume a logical "1." This condition inhibits action of the Oscillator, thereby preventing the alarm from sounding. This condition exists until capacitor 38 has charged sufficiently so that the voltage at the junction of capacitor 38 and resistor 37, and hence the voltage at input A of gate 34, becomes a logical "0." At that time the alarm circuitry is enabled. The time for this to occur is chosen to correspond to the time for the sensor to reach operating temperature.

Another feature of this invention is a visual monitor for indicating the integrity of the system. This feature is achieved using transistor 40 and lamp 41. Under normal quiescent conditions the output of gate 32 is a logical "0." This output is fed via a current limiting resistor to the base of transistor 40. A logical "0" at the base of transistor 40 does not allow that transistor to conduct, and lamp 41 is not lit. If system integrity fails, the output of gate 32 goes to a logical "1" in the manner previously described, thereby causing transistor 40 to conduct to lamp 41 whereby a visual indication of system integrity results.

The Oscillator, illustrated in FIG. 2 is of the Variable Duty type and comprises NOR gates 42 and 43, capacitor 45, variable resistors 44 and 45 and diodes 46 and 47. If no alarm condition exists, the logical "1" output of gate 34 clamps the oscillator in the off state, so that the output of gate 42 is relatively low while the output of gate 43 is high. When an alarm condition occurs, the output of gate 34 goes low, thereby enabling the oscillator. When input A of gate 42 goes low, the gate immediately changes state and the output goes high, thereby causing gate 43 output to go low. This causes capacitor 45 to commence charging through diode 46, and resistor 44. While this is occurring transistor 50 is turned on, causing transistor 52 to be turned on and sound the alarm. Resistors 49 and 51 limit the base currents in transistors 50 and 52, respectively, to the proper values for proper operation in a manner well known in the art. The alarm is enabled until capacitor 48 has charged sufficiently to cause a logical "1" to be presented at input B of gate 42. When this occurs, the gate 42 output goes low causing gate 43 to go high and turn off the alarm. At the same time, capacitor 45 commences discharging through variable resistor 45 and diode 47. This condition exists until capacitor 43 has discharged sufficiently so that the inputs to gate 43 goes low causing the alarm cycle to repeat. This action continues as long as the output of gate 34 is low. Alarm "on" time is controlled by variable resistor 44, and alarm "off" time is controlled by variable resistor 45. "On" time and "off" time may be adjusted by simply adjusting variable resistors 44 and 45, so that optimum alarm notification performance is achieved for the particular application.

Figure 3:
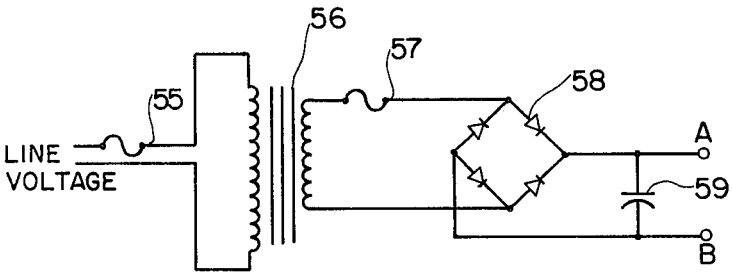
FIG. 3 is a schematic representation of a normal power supply, deriving power from a household type electrical system.

FIG. 3 is a schematic representation of a Normal Power Supply, operable to derive power from a household type electrical system. Household electrical power is fed to transformer 56, through a fuse 55. The household electrical power is transformed to the desired value by transformer 56. This transformed voltage is passed by fuse 57, to be then rectified by bridge rectifier 58, and smoothed by capacitor 59.

Figure 4:
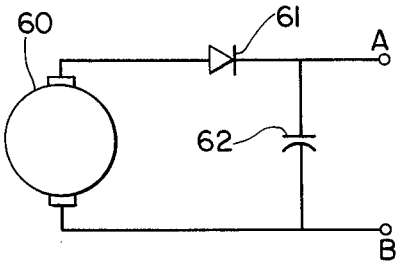
FIG. 4 is a schematic representation of a normal power supply deriving power from a vehicular type generator, or alternator.

FIG. 4 is a schematic representation of a Normal Power Supply that derives power from a vehicular type generator or alternator. The output of generator or alternator 60 is passed through diode 61, and then smoothed by capacitor 62.

Figure 5:
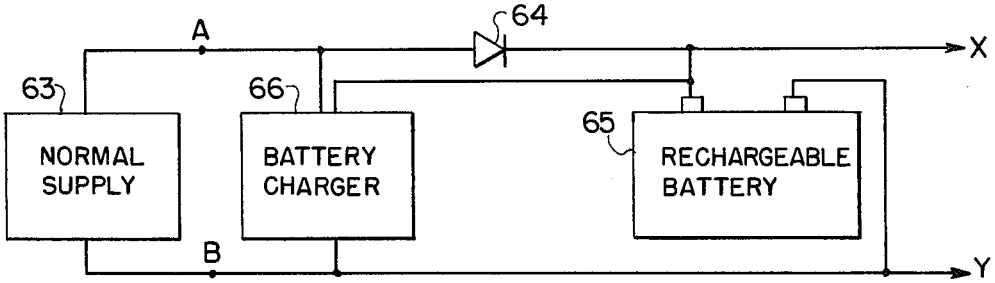
FIG. 5 is a schematic representation of an Emergency Back-Up Power Supply using rechargeable batteries.

FIG. 5 schematically represents an Emergency Back-Up Power Supply using a rechargeable battery 65 and a Normal Power Supply 63, which can be as illustrated in FIGS. 3 or 4, or, alternatively, any other source of DC power. The rechargeable battery 65 is permanently connected to battery charger 66, to maintain the battery constantly charged. During normal operation, power for use in the circuitry of FIG. 2 is primarily supplied from normal supply 63, with the rechargeable battery functioning to smooth out voltage variations inherent in the normal supply 63. During normal operation, battery charger 66 supplies power to battery 65 to replace power consumed within the circuitry of FIG. 2, thereby battery 65 is maintained with a full charge. Should normal supplies 63 fail, all power necessary to operate the circuitry of FIG. 2 is automatically furnished by battery 65. Diode 64 prevents power from battery 65 from flowing to the normal supply 63 in the event of failure of the normal power supply.

Figure 6:
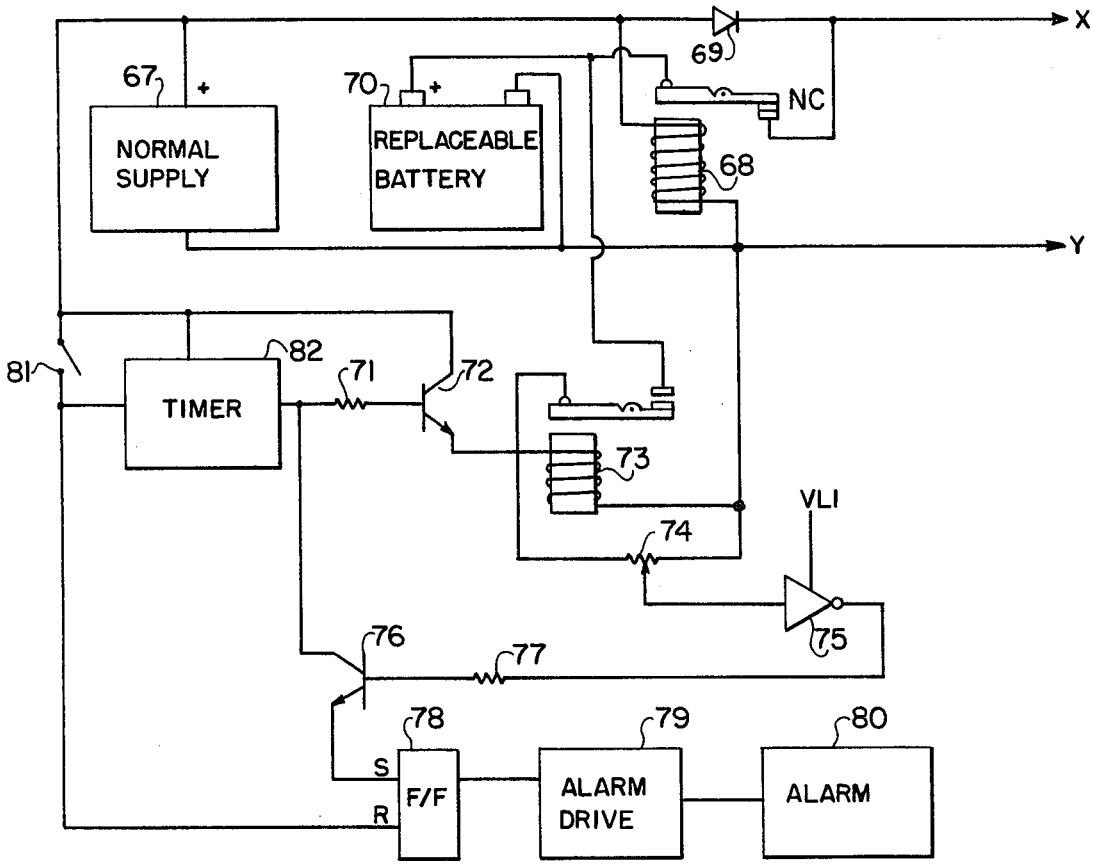
FIG. 6 is a schematic representation of an Emergency Back-Up Power Supply using replaceable batteries.

FIG. 6 schematically represents an emergency back-up power supply using replaceable batteries. During normal operation, power for the circuit of FIG. 2 is furnished by normal supply 67, through diode 69. During normal operation, relay 68 is energized so that its contacts are open, thereby preventing the circuitry of FIG. 2 from drawing any power from replaceable battery 70. In the event the normal supply fails, relay 68 is deenergized, and its contacts close, whereby replaceable battery 70 supplies power to the circuitry of FIG. 2. Diode 69 prevents power from the replaceable battery 70 from flowing back to the normal supply, while also preventing the rechargeable battery from energizing relay 68. FIG. 6 further illustrates circuitry and equipments to monitor the condition of replaceable battery 70, and to sound an alarm if the battery voltage has dropped so low as to be no longer useable. Timer 82 generates a pulse at periodic intervals, with a desirable rate being once every 24 hours. This pulse is a positive pulse that is applied to the base of the transistor 72, which in turn energizes relay 73. This action connects the replaceable battery 70 to ground, through a resistor 74 whose resistance is chosen to be equal to the input resistance of the circuitry of FIG. 2. The voltage which appears at the top of resistance 74 is now the voltage that the battery 70 would furnish to the circuit of FIG. 2 if the system were in an emergency back-up operation. The wiper arm of resistor 74 had previously been adjusted so that the output of invertor 75, which is supplied power at VL1 as in FIG. 2, is a logical "0" if the battery 70 voltage is high enough to operate the circuit of FIG. 2, and is a logical "1" if the voltage of battery 70 is too low to operate the circuit of FIG. 2. If the output of invertor 75 is low, transistor 76 will not turn on and nothing further happens. If the output of invertor 75 is a logical "1," it turns on transistor 76, through limiting resistor 77, thereby setting flip-flop 78, which had previously been placed in the reset condition. When flip-flop 78 is in the "set" condition, the output is a logical "1" which turns on the alarm drive 79, sounding alarm 80 as an indication that the battery needs to be replaced. Additionally, the low-battery alarm may be turned off for a period of time equal to the timing period of timer 82, thereby eliminating the nuisance of a constantly sounding alarm and reducing the possibility that the user will disconnect the entire alarm. Switch 81 can be depressed to place flip-flop 78 in a reset condition, thereby turning off the alarm 80 while also restarting timer 70 at time zero. The sequence will be repeated at the end of the next timing interval of timer 82 if the low battery 70 is not replaced.

Figure 7:
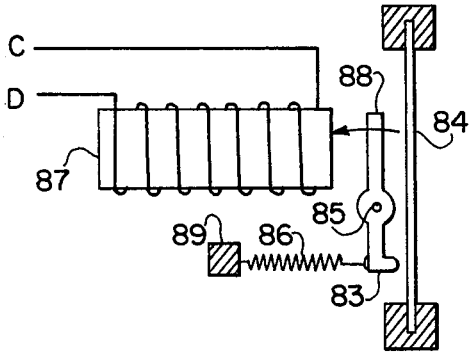
FIG. 7 is a schematic representation of a novel sounding device suitable for use in a combustible, flammable or otherwise reactive environment.

FIG. 7 schematically represents a sounding device of this invention which is suitable for use in flammable, combustible or otherwise reactive atmospheres. It is somewhat similar to existing interruptor-contact sounding devices such as bells, buzzers and horns, in that sound is produced by the action of a hammer striking a sounding element such as a metal diaphragm or a resonant metal shape. It differs from these existing devices in that no electrical arcs are created in operation.

The sounding device of this invention consists of an electromagnet 87 which, when energized, pulls hammer arm 88 in the direction shown by the arrow, around pivot 85, causing the hammer 83 to strike the sound making element 84, thereby creating sound. The signal to energize the electromagnet 87 comes from a signal generator and power driver such as the Variable Duty-Cycle Oscillator and Alarm Power Drive of FIG. 2. The driving signals are chosen so that hammer 83 alternately strikes the sound making elements 84 and returns to its rest position by a spring 86 that is secured to an anchor 89.

Figure 8:
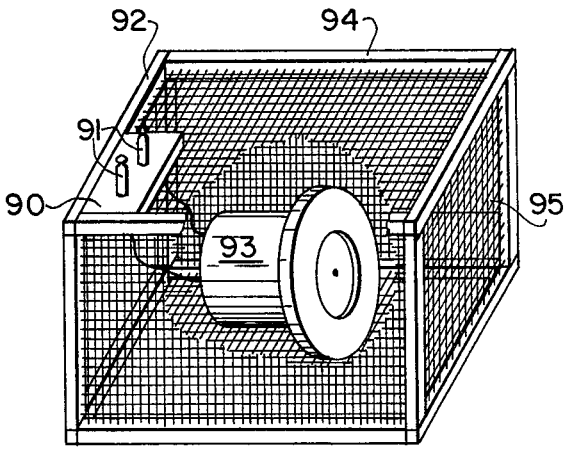
FIG. 8 is a pictorial representation of another new design of a Sounding Device suitable for use in a combustible, flammable or otherwise reactive environment.

FIG. 8 pictorially represents in partial section, another sounding device of this invention which is suitable for use in flammable, combustible or otherwise reactive atmospheres. This sounding device is a modification of existing interruptor-contact type sound devices such as bells, buzzers, or horns. The modification is achieved by enclosing the buzzer, bell or horn type sounding device, 93, in a wire mesh enclosure 94 of suitable characteristics to prevent propogation of a flame through its mesh. Frame 92 supports the mesh 95 and a terminal block 90 provides for connection to the sounding device 93 through terminals 91. A suitable mesh is a double layer of stainless steel mesh having approximately 100 squares to the inch. In operation, a DC signal is applied to terminals 91, thereby causing sounding device 93 to operate. Concommitantly, a series of sparks are produced within the sounding device. A combustible, flammable, or otherwise reactive gas may be ignited by the sparks but cannot propogate outside the wire mesh, and is quenched. Hence, the modified bell, buzzer or horn becomes suitable for use in a combustible, flammable or otherwise reactive environment. In actual practice, the entire sounding device may not be enclosed in a wire mesh, but alternatively all holes in the device may be so covered.

While various novel embodiments have been disclosed for practicing this invention, the invention is understood to be defined by the scope of the appended claims.

I claim:

1. A smoke, fire and gas alarm characterized by a plurality of remote sensors and a central control and alarm unit, comprising:

A. a plurality of remote gas sensing means which respond to the presence of carbon monoxide and the like by a lowered electrical resistance; and B. a centralized power supply operable for generating a D.C. supply voltage to each of said remote sensors, and for generating further distinct voltage levels VL1 and VL2, said power supply being characterized by a normal supply source and an alternate supply source, and including automatic means to switch therebetween; and C. centralized threshold circuits for each of said remote sensors, each threshold circuit being adapted to compare said voltage level VL2 with a voltage from its associated sensor to produce a sensor output voltage; and D. a centralized processing unit for receiving a sensor output voltage from each of said threshold circuits, said processing unit comprising logic element means for comparing each of said plurality of sensor output voltages with said voltage levels VL1 and VL2, said logic means further being adapted for generating an enabling processing unit output signal in response to either increase or a decrease of any of said sensor output voltages; and E. a centralized alarm power drive for receiving said processing unit output signal, said alarm drive comprising a oscillator for generating a variable alarm signal; and F. a centralized alarm, responsive to said alarm signal, and further comprising an interruptor device having means to prevent ignition of an explosive gas in the vicinity of said alarm.

2. An alarm system as in claim 1 wherein at least one of said plurality of remote sensors comprises a doped semiconductor resistance with a heater for maintaining said semiconductor at an elevated temperature, said heater being supplied with said supply voltage through a remotely mounted zener diode to maintain proper heater voltage irrespective of supply voltage variations.

3. An alarm system as in claim 2 wherein at least one of said plurality of remote sensors includes a thermostatic switch operable to short circuit said electrical resistance in response to an elevated temperature.

4. An alarm system as in claim 1 wherein said centralized processing unit logic means further comprises a NAND gate having a plurality of inputs, one for connection to each of the plurality of sensor output voltages, and an OR gate having a plurality of inputs, one for connection to each of said plurality of sensor output voltages, said NAND gate and said OR gate being thereby in parallel input connection to each of said plurality of sensor output voltages, the outputs of said NAND and OR gates comprising inputs to further logic means being adapted for generating said enabling processing unit output signal in response to a change in either gate, wherein each of said threshold circuits is adapted to decrease its sensor output voltage in response to a decrease in resistance of said sensor resistance, and thereby change said NAND gate, and said each threshold circuits is adapted to increase said sensor output voltage in response to an open circuit between its remote sensor and said threshold circuit, and thereby change said OR gate.

5. An alarm system as in clsaim 4 wherein said voltage level VL2 is less than said voltage level VL1, said voltage level Vl2 being a reference to said NAND gate and said voltage level VL1 being a reference to said OR gate.

6. An alarm system as in claim 5 wherein said processing unit further includes sensor self-monitoring circuitry means comprising a resistance connected to the output of said OR gate, said resistance being connected to a first input of a NOR gate, a second zener diode connected between a relatively zero level of said D.C. supply voltage and said same first input of said NOR gate, wherein the output of said NAND gate is connected to a second input of said NOR gate, said NOR gate being referenced to said voltage level VL2, and said second zener diode having a zener value equal to VL2.

7. An alarm system as in claim 6 wherein the output of said NOR gate is connected to one input of a second OR gate, said second OR gate being referenced to said voltage level VL2, the second input of said second OR gate being connected to a source of said voltage level VL2 through a capacitor, whereby the output of said second OR gate is said processing unit output signal, and which is maintained disabled during an initial stabilization period for said remote sensors.

8. An alarm system as in claim 6 wherein said alternate source further comprises a condition monitoring circuit means adapted to sound said alarm if the voltage of said alternate source drops below a predetermined level.

9. An alarm system as in claim 1 wherein at least one of said plurality of remote sensors includes a thermostatic switch operable to short circuit said electrical resistance in response to an elevated temperature.

10. An alarm system as in claim 9 wherein said alternate source further comprises a condition monitoring circuit means adapted to sound said alarm if the voltage of said alternate source drops below a predetermined level.

11. An alarm system as in claim 1 wherein said centralized alarm comprises an electromagnet adapted to be selectively energized for urging a hammer against a sound making element, a spring adapted to return said hammer from said sound making element during non-energization of said electromagnet, wherein an interrupting signal from said oscillator is operable to energize said electromagnet and produce an audible interrupting sound.

12. An alarm system as in claim 1 wherein said centralized alarm comprises an interrupting-contact sound device enclosed within a wire mesh enclosure, wherein said mesh is adapted to prevent propagation of a flame from the vicinity of arcing contacts within said sound device through said mesh.

13. An alarm system as in claim 1 wherein said alternate power supply source comprises a rechargeable battery in parallel with a normal D.C. power supply, a battery charger activated by said normal supply for maintaining said rechargeable battery, and a diode between said rechargeable battery and said normal supply to prevent power from said battery from flowing towards said normal supply in the event of failure of the same.

14. An alarm system as in claim 1 wherein said normal power supply includes means to furnish said voltages through a diode, with a relay between said alternate source and the output voltage of said diode, wherein said relay is de-energized upon failure of said normal supply and adapted to switch to said alternate source.

15. An alarm system as in claim 14 wherein said alternate source further comprises a condition monitoring circuit means adapted to sound said alarm if the voltage of said alternate source drops below a predetermined level.

16. An alarm system as in claim 15, wherein said condition monitoring circuit means further comprises a relay means adapted to be periodically energized by a pulse from a timer means, whereupon said relay means is adapted to momentarily connect said replaceable battery to ground through a resistance, a battery voltage threshold means adpated to momentarily sound said alarm upon sensing a less than predetermined level of voltage from said replaceable battery when it is so momentarily connected to ground.

* * * * *